United States Patent [19]

Lorenzini

[11] 4,185,535

[45] Jan. 29, 1980

[54] REED-HOLDING DEVICE

[76] Inventor: Robert A. Lorenzini, 603 S. State Rd. 7, Margate, Fla. 33068

[21] Appl. No.: 967,986

[22] Filed: Dec. 11, 1978

[51] Int. Cl.[2] ..... G10D 9/02

[52] U.S. Cl. ..... 84/383 R

[58] Field of Search ..... 84/383 R, 383 A, 380, 84/382, 385, 453

[56] References Cited

U.S. PATENT DOCUMENTS

| | | | |
|---|---|---|---|
| 555,561 | 3/1896 | Cadwallader | 84/383 R |
| 2,483,327 | 9/1949 | Stalowski | 84/383 R |
| 4,056,997 | 11/1977 | Rovner | 84/383 R |

FOREIGN PATENT DOCUMENTS

| | | | |
|---|---|---|---|
| 54389 | 4/1890 | Fed. Rep. of Germany | 84/383 R |
| 66484 | 1/1893 | Fed. Rep. of Germany | 84/383 R |
| 384940 | 3/1923 | Fed. Rep. of Germany | 84/383 R |

*Primary Examiner*—Lawrence R. Franklin
*Attorney, Agent, or Firm*—John Maier, III

[57] ABSTRACT

A reed-holding device for retaining a single reed on the mouthpiece of a woodwind instrument such as a clarinet or saxophone. A string extends from brackets. Grooves in the brackets maintain various sections of the string equally-spaced from one another.

7 Claims, 5 Drawing Figures

REED-HOLDING DEVICE

BACKGROUND OF THE INVENTION

The present invention relates to a reed-holding device which is commonly referred to as a ligature and more specifically to a reed-holding device utilizing sections of a string in an equally-spaced relationship with one another.

In the past, a hand-wound string for holding the reed on a clarinet or saxophone was used. In Europe, it is still used. A string is preferred because the resilience of a string provides sufficient flexibility to the reed to produce a superior quality of tone, timbre and sound. The use of such hand winding of reeds has become decreasingly popular, however, because it is time consuming and must be redone frequently. The need for quick and easy adjustment and replacement of reeds has resulted in the use of various types of ligatures, such as metal bands, to hold the reed in place. However, such reed-holding devices result in a loss of tone quality due to their inflexibility and rigidity. It is also known that wide and even spacing between the sections of the string provides the finest quality of tone, timbre and sound. Therefore, there is a need for a ligature or reed-holding device which can be readily utilized but which makes possible quality musical production.

The Cadwallader U.S. Pat. No. 555,561 does show the use of a ligature with both brackets and strings. However, Cadwallader does not teach any provision for maintaining equal string spacing.

The Bundy U.S. Pat. No. 2,200,054 shows a slotted band for use as a ligature. Bundy, apparently recognized the disadvantages of a rigid band and utilized a series of slots to provide flexibility.

The Stalowski U.S. Pat. No. 2,483,327 uses a bracket with a fabric piece rather then strings thus eliminating the advantages of string.

The Rovner U.S. Pat. No. 4,056,997 shows a band with the overlapping of material at the side walls and with a single layer of material at the base.

None of these patents show a convenient ligature having the quality of tone and timbre obtainable with the string maintained equally-spaced along the reed.

These and various other problems were not satisfactorily resolved until the emergence of the instant invention.

SUMMARY OF THE INVENTION

In accordance with the present invention, there is provided a reed-holding device for woodwind instruments. The present invention further provides a convenient reed-holding device for obtaining the quality of tone and timbre achievable by the use of equally-spaced string for holding the reed to the mouthpiece of a woodwind instrument.

The novel features which are considered as characteristic of the invention are set forth with particularity in the appended claims. The invention itself, however, as to its construction and obvious advantages will be best understood from the following description of the specific embodiment when read with the accompanying drawings.

DETAILED DESCRIPTION OF THE PREFERRED EMBODIMENTS OF THE INVENTION

Figure 1:
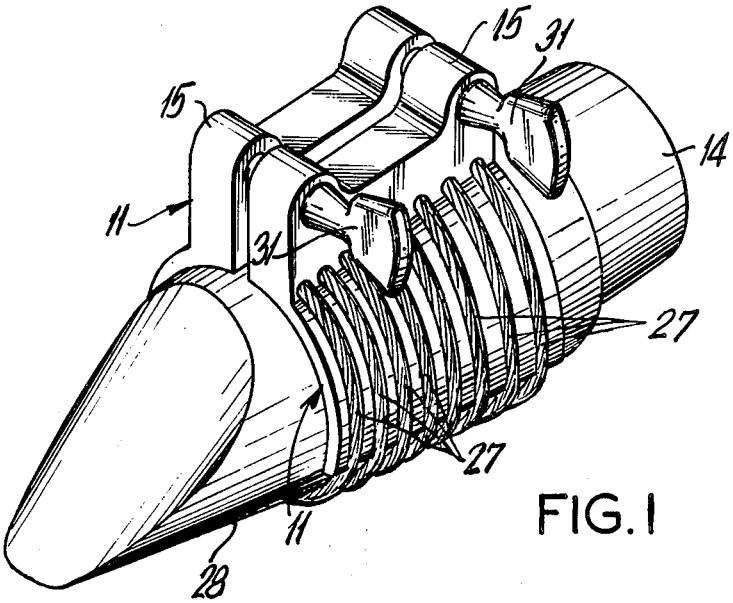
FIG. 1 is a perspective view showing a reed-holding device in place on the mouthpiece of a clarinet.
Figure 2:
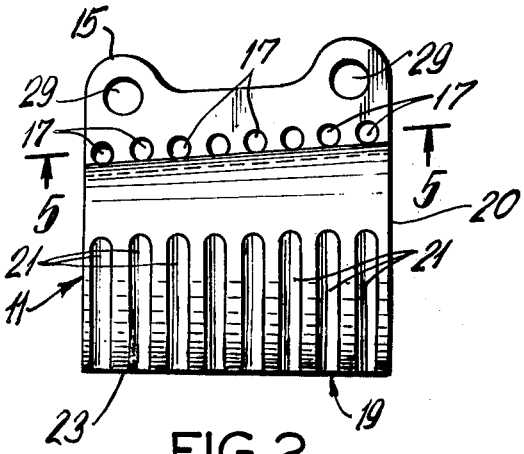
FIG. 2 is a side view of the reed-holding device.
Figure 3:
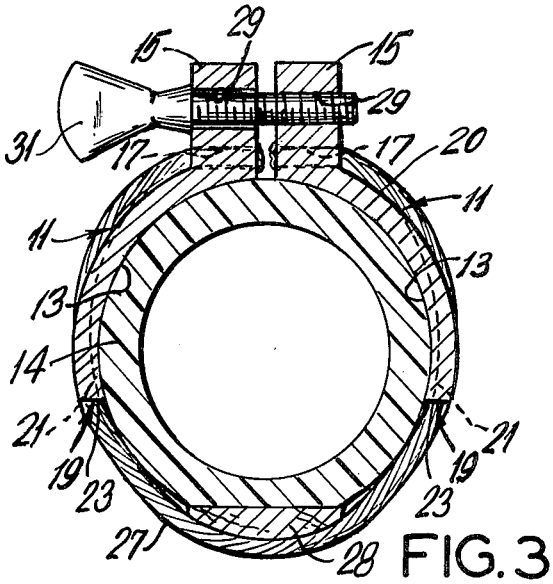
FIG. 3 is an end view of the reed-holding device.
Figure 4:
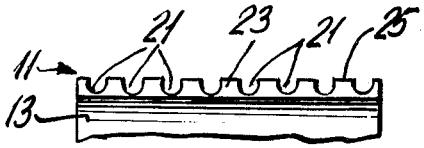
FIG. 4 is a top view of the lower edge of one bracket broken away.
Figure 5:
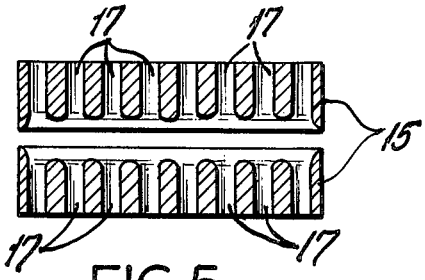
FIG. 5 is a cross-sectional view along lines 5—5 of FIG. 2.

The same reference numerals are used throughout the drawings and specification to denote a similar item of the invention.

Referring to FIG. 1 of the drawings, the reed-holding device includes a pair of brackets 11 which are rigid. Each bracket includes a mounting portion 13 having a cross-section which is a partial circumference of a circle for mounting on the mouthpiece 14 of a woodwind instrument. If the mouthpiece 14 of the woodwind instrument tapers, the brackets 11 also taper resulting in a frustoconical configuration. Each bracket 11 covers only a portion of the outer surface of the mouthpiece 14. Preferably, each bracket 11 covers the upper quarter of the circumference of the mouthpiece plus a portion of the lower quarter. The brackets 11 include a pair of protrusions 15 which extend outwardly along the line of the diameter of the mouthpiece from the mounting portion 13. In the protrusion 15 of each bracket 11, where the protrusion 15 joins the mounting portion 13, there are a series of substantially equally-spaced holes 17. Preferably, there are eight such holes 17. Each of the holes 17 in a bracket 11 aligns with a corresponding hole 17 in the other bracket 11 and all the holes in both brackets 11 are located in a common plane. Each mounting portion 13 has a lower section 19 and an upper section 20. Along the lower section 19 of each mounting portion 13, a series of grooves 21 extend downwardly to the lower edge 23 of the bracket 11. The grooves 21 are equally-spaced and are substantially parallel to one another. The further the groove 21 extends toward the lower edge, the greater is the depth of the groove 21 into the bracket 11. The grooves 21 extend over only the lower section 19 of the mounting portion 13. The center line of each groove 21 is aligned with one of the holes 17 in the protrusion.

A string 27 is secured in one end opening or hole 17. The string 27 is placed in grooves 21 aligned in opposite mounting portions 13. In this way, each string 27 is held within the grooves 21 aligned with the holes 17 where the string 27 is fastened. The string 27 is directed along the interior of the protrusion 15 to the next hole 17 where the string 17 is directed outwardly and again through a pair of aligned grooves 21 while passing over the reed 28 being held against the mouthpiece 14. In this manner, the grooves 21 assure that the various sections of the string 27 will be maintained in an equally-spaced relationship from one another.

In each protrusion 15, a pair of openings 29 are provided, which are threaded in one protrusion 15 and are not threaded in the other protrusion. However, each opening 29 in a protrusion 15 aligns with an opening 29 in the other protrusion 15. A pair of thumb screws 31 are placed through the openings 29 without threads to engage the threads of the threaded openings 29. This provides for tensioning of the reed-holding device by forcing the protrusions 15 closer and closer together which draws the string sections in tension as tightening down on the thumb screws occurs.

The invention may be embodied in other specific forms without departing from the spirit or essential characteristics thereof. The present embodiments are, therefore, to be considered in all aspects as illustrative and not restrictive. The scope of the invention being indicated by the appended claims rather than the foregoing description and all changes which come within the meaning and range of equivalency of the claims are therefore, intended to be embraced therein.

I claim:

1. A reed-holding device for a mouthpiece of a woodwind instrument comprising:

a pair of brackets, each bracket having a mounting portion with a cross-section which is a partial circumference of a circle adapted to embrace the mouthpiece of a woodwind instrument, each mounting portion having an upper section and a lower section, each bracket having a protrusion extending diametrically outwardly from the upper section of the mounting portion, said protrusions each being located adjacent one another and having a series of substantially equally-spaced holes, each hole being aligned with a corresponding hole within the other protrusion, each mounting portion having a series of substantially parallel equally-spaced grooves extending circumferentially about its lower section, the centerline of each groove being aligned with the centerline of one of said openings;

a string means extending from said aligned holes and extending through the aligned grooves in each bracket; and fastening means partially coextensive with said protrusions for tensioning said string means.

2. A reed-holding device according to claim 1 wherein each bracket extends more than one-quarter of the circumference of the mouthpiece.

3. A reed-holding device according to claim 2 wherein each groove becomes increasingly deeper as the groove extends away from the protrusion into the lower section of the mounting portion of the rigid bracket.

4. A reed-holding device according to claim 3 wherein said fastening means includes a pair of thumbscrews.

5. A reed-holding device according to claim 2 wherein the grooves in each bracket extend less than one-half the circumferential distance along the lower section of the mounting portion of each bracket.

6. A reed-holding device according to claim 1 wherein each groove becomes increasingly deeper as the groove extends away from the protrusion into the lower section of the mounting portion of the bracket.

7. A reed-holding device according to claim 1 wherein said fastening means includes a pair of thumbscrews.

* * * * *